US009347155B2

(12) United States Patent
Terashima

(10) Patent No.: US 9,347,155 B2
(45) Date of Patent: May 24, 2016

(54) PROCESS FOR MANUFACTURING TO A TAPE WITH SPECIFIC PATTERN INTERVAL

(71) Applicant: Nippon Dom Co., Ltd., Fukui (JP)

(72) Inventor: Hideki Terashima, Fukui (JP)

(73) Assignee: Nippon Dom Co., Ltd., Fukui (JP)

( * ) Notice: Subject to any disclaimer, the term of this patent is extended or adjusted under 35 U.S.C. 154(b) by 344 days.

(21) Appl. No.: 14/048,497

(22) Filed: Oct. 8, 2013

(65) Prior Publication Data

US 2014/0033488 A1 Feb. 6, 2014

Related U.S. Application Data

(63) Continuation-in-part of application No. 12/986,421, filed on Jan. 7, 2011, now abandoned, which is a continuation-in-part of application No. 11/658,484, filed as application No. PCT/JP2005/013140 on Jul. 15, 2005, now abandoned.

(30) Foreign Application Priority Data

Jul. 28, 2004 (JP) ..... 2004-219621

(51) Int. Cl.
*D03D 15/00* (2006.01)
*D03D 1/00* (2006.01)
*G09F 3/02* (2006.01)
(Continued)

(52) U.S. Cl.
CPC ..... *D03D 15/0033* (2013.01); *D03D 1/00* (2013.01); *D03D 1/0011* (2013.01); *D03D 15/00* (2013.01); *G09F 3/02* (2013.01); *G09F 3/0291* (2013.01); *G09F 3/0292* (2013.01);
(Continued)

(58) Field of Classification Search
CPC ..... D02H 3/00; D02H 5/02; D02H 3/02; D02H 5/00; D03D 15/0033; D03D 15/00; D03D 1/00; D03D 1/0011
USPC ..... 28/178, 179, 184, 190
See application file for complete search history.

(56) References Cited

U.S. PATENT DOCUMENTS 4,009,512 A * 3/1977 Baba ..... D02H 5/02 26/28
4,364,157 A * 12/1982 Cutts ..... D06B 23/06 118/212

(Continued)

FOREIGN PATENT DOCUMENTS

DE EP 0919650 A1 * 6/1999 ..... D03D 1/0011
JP 07092911 A * 4/1995

OTHER PUBLICATIONS

English language translation of JP 07-092911, document publication date Apr. 1995, translation 20 pages.*

*Primary Examiner* — Amy Vanatta
(74) *Attorney, Agent, or Firm* — Kirschstein, Israel, Schiffmiller & Pieroni, P.C.

(57) ABSTRACT

In a process for manufacturing to a tape with specific pattern interval, there are utilized at least two kinds of ultraviolet-fluorescent yarns with different chromophore, which is spun out of dope kneaded with a fluorescent material. When ultraviolet-fluorescent yarns and colorless yarns are wound around a warp beam or drum with or without infrared-fluorescent yarns, the ultraviolet-fluorescent yarns are arranged repeatedly in specific color order in the traverse direction during the warping operation. In the process, these yarns as the warp are also woven into a double-wide textile with a wide loom.

5 Claims, 5 Drawing Sheets

(51) Int. Cl.
*G09F 3/00* (2006.01)
*B42D 25/387* (2014.01)

(52) U.S. Cl.
CPC ..... *G09F 3/0294* (2013.01); *B42D 25/387* (2014.10); *D10B 2331/04* (2013.01); *Y10T 428/24835* (2015.01)

(56) References Cited

U.S. PATENT DOCUMENTS 4,407,767 A * 10/1983 Seaborn ..... D02H 13/26 264/238
4,641,404 A * 2/1987 Seydel ..... B05C 1/0817 118/234
4,921,280 A * 5/1990 Jalon ..... D06M 13/50 283/88
5,824,393 A * 10/1998 Nakamura ..... D03D 1/0011 428/195.1
5,941,572 A * 8/1999 Gundjian ..... B41M 3/142 283/67
6,068,895 A * 5/2000 Kimura ..... D01F 1/10 428/29
6,296,022 B1 * 10/2001 Lowe ..... D03D 1/0011 139/1 R
6,764,970 B1 * 7/2004 Kuoni ..... D03D 1/0011 139/426 R
2003/0093885 A1 * 5/2003 Inoue ..... A44B 17/0064 24/381

* cited by examiner

PROCESS FOR MANUFACTURING TO A TAPE WITH SPECIFIC PATTERN INTERVAL

CROSS-REFERENCE TO RELATED APPLICATIONS

The present application is a continuation-in-part of co-pending U.S. patent application Ser. No. 12/986,421, entitled "Security Tape with Specific Pattern Interval" filed on Jul. 1, 2011 and U.S. patent application Ser. No. 11/658,484, entitled "Tape of Obtaining Printed Labels and Process for Manufacturing the Tape" filed on Jan. 24, 2007, which are incorporated herein by reference in its entirety.

TECHNICAL FIELD

The present invention relates process for manufacturing to a tape with specific pattern interval, the tape being useful for obtaining informative printed label, ribbon or ornamental tape sewed on clothing, whose specific repetitive pattern can be identified by irradiation of ultraviolet and/or infrared rays, and particularly a process for manufacturing appropriately a security tape of various width from a double-wide textile having the same repetitive pattern.

BACKGROUND ART

In recent years, there has concentrated popularity on goods to which a famous brand is sewn and then a large amount of imitation goods for which the brand is used illegally have appeared in a domestic clothing market. As this result, affairs where sales on famous brand goods are not only inhibited but also confidence in the quality of the brand goods is lost have happened frequently. Especially, since imitation goods are manufactured by low-paid worker of under-developed country and imported and sold at a farther low price than famous brand goods, they give remarkable damage to manufacturer and distributor of famous brand goods. It is difficult even for those skilled in the art to distinguish the imitation goods from famous brand goods because the imitation goods closely resemble the famous brand goods as dyeing and needlework technologies advance rapidly about clothing. The imitation goods are therefore sold through the route similar to the famous brand goods for a long term and manufacturer and distributor of the famous goods brands sustain a big loss.

Various prosecution means are now proposed to prosecute unjustified imitation goods in the early stages about clothing. For example, EP-A1-0328320, JP-A2-H06-306727 or JP-A2-H07-92911 discloses that a decorative woven label is prepared by interweaving photochromic yarns containing inorganic or organic fluorescent material with normal yarns. This woven label is sewn on clothes. It is possible to identify the imitation goods with or without photochromic yarns in the label by irradiating it with ultraviolet rays when necessary. JP-A2-H07-92911 discloses that a woven label or cloth is woven out of yarns containing red, blue and/or green fluorescent materials. JP Patent No. 2986714 whose inventor is this applicant's employee also utilizes ultraviolet-fluorescent materials that emit a red, blue or green visible light.

[Cited Reference 1] EP-A1-0328320
[Cited Reference 2] JP-A2-H06-306727
[Cited Reference 3] JP-A2-H07-92911
[Cited Reference 4] JP Patent No. 2986714

DISCLOSURE OF THE INVENTION

Problems to be Solved by the Invention

Said security woven label has been already acknowledged in the textile trade widely. The woven label has the effect of judgment on genuineness or spuriousness for comparatively a short term until it becomes well-known that certain fluorescent yarns are interwoven into the woven label. When label maker receives similar orders from many garment producers, i.e., label users about this woven label, security by the woven label will vanish if he cannot deliver them with different chromophore to each garment producer. It is therefore necessary to identify each garment producer by interweaving ultraviolet-fluorescent yarns in the different numbers into the woven label for each garment producer, or at the different intervals between each two yarns in the case when applying two or more yarns. Even if such discretion measure is executed, the number of corrective garment producers is confined to at most ten or more companies. Weave label is also used as trademark sewn mostly on the reverse side of clothes, bags, small clothing articles, blankets or the like. The trademark having complex beautiful pattern are woven with loom on which jacquard is mounted. When ultraviolet-fluorescent yarns are interwoven into the center of woven label braided from float portions of many color yarns indicating some characters and/or designs, the yarns are sunk into the label, so that judge operation with ultraviolet radiation becomes difficult or unpleasant sensation is liable to occur on the label design. Therefore, it is only possible to interweave ultraviolet-fluorescent yarns into the periphery of woven label. Interweaving ultraviolet-fluorescent yarns is so limited to the label periphery that the number of corrective garment-production users decreases less than ten companies. In this case, this Applicant who exceeds one hundred or more customers i.e., garment-production users cannot correspond at all.

As disclosed in JP-A2-H07-92911, the number of corrective garment-production users must greatly increase when red, blue and/or green ultraviolet-fluorescent yarns are utilized for making trademark label as to an alternation of interweaving thereof for each users. This woven label has colorful designs and the ground weave thereof is braided out of color yarns as the warp and weft rather than colorless or white, so that it is necessary to color ultraviolet-fluorescent yarns in the same way. It is hard to judge whether chromophore is blue or green or not by radiation of ultraviolet rays in the case when ultraviolet-fluorescent yarns are colored green or blue. It becomes difficult to distinguish chromophore of photochromic yarns when the brightness of the ground weave lowers like black. The number of corrective garment-production users does not therefore increase so much by means of the use of red, blue and/or green ultraviolet-fluorescent yarns in the case of the decorative woven label.

As the other problem of woven label, since trademark-showing label is different in size or planar shape for every kind and quality of garments made by each garment-production user, there are a lot of labels different in number of the warp, width, length or density. So as to interweave same number of ultraviolet-fluorescent yarns at the similar warp position and interval about woven labels different in size of one garment-production user, it is indispensable to determine exact numbers and interweave position of every ultraviolet-fluorescent yarns during the warping operation. This operation is still very serious at the present time that it is managed with a computer. It is also impossible to prosecute imitation goods for thin jacket, trousers and underwear in summer because trademark-showing label is not often sewn on the reverse side thereof.

This inventor has examined the above-mentioned problem concerning security woven label from the viewpoint of label maker. In this examination, label sewn on garments includes colorless cloth slip on which washing-indication, descriptive, disclaimer mark or the like is printed, namely, printed label in addition to trademark-showing woven label. This inventor has paid attention to the printed label whose body is colorless before printing regardless of size thereof. About the printed label, a thin colorless tape on which letters and/or design are printed with screen printing machine, letterpress printing machine or the like is cut into pieces and then sewn on the reverse side of clothes. Each label user such as garment producers utilizes colorless tape for making printed label in the same manner even if printed label is different in size about each label user. It is thus possible to prepare high-general security label by interweaving appropriately ultraviolet-fluorescent yarns.

It is therefore an object of the present invention to provide a process for manufacturing a tape of obtaining printed label having a specific pattern interval that appears in sight by irradiation of ultraviolet and/or infrared rays even if the label is of any width.

Another object of the present invention is to provide a process for manufacturing a security tape useful for a ribbon or an ornament tape sewed on clothing having a specific pattern interval that appears in sight by irradiation of ultraviolet and/or infrared rays even if the tape is of any width.

Further object of the present invention is to provide a process for manufacturing a security tape so that label manufacturer can promptly deliver security label in different size at a low price.

A tape according to the present invention is cut into labels after pattern and/or character were printed on the surface thereof for use as informative security label. The tape of the present invention comprises a tape body that is colorless when irradiating it with a visible light, and at least two kinds of ultraviolet-fluorescent yarns with different chromophore, which are interwoven into the tape body in parallel with other yarns. As for the tape of the present invention, the ultraviolet-fluorescent yarns are arranged in specific color order in the traverse direction of the tape. The color order is repeated every four or more rows by means of two kinds of yarns, every three or more rows by means of three kinds of yarns or every two or more rows by means of four or more kinds of yarns over the total width of the tape so that the specific repetitive pattern on the label may be identified by irradiation of ultraviolet rays.

In the tape of the present invention, it is preferable that prescribed width of the first and end rows of ultraviolet-fluorescent yarns are defined while arranging them in specific color order. In this case, the color order is repeated every three or more rows by means of two kinds of yarns in the traverse direction of the tape so that the specific repetitive pattern on the label may be identified by irradiation of ultraviolet rays.

As for the tape of the present invention, instead of one kind of ultraviolet-fluorescent yarns, infrared-fluorescent yarn may be interwoven into the tape in parallel with other yarns so that the specific repetitive pattern on the label may be identified by irradiation of both ultraviolet and infrared rays. Infrared-fluorescent yarn may be also interwoven into the tape in parallel together with plural rows of ultraviolet-fluorescent yarns so that the specific repetitive pattern on the label may be identified by irradiation of both ultraviolet and infrared rays. As for the tape of the present invention, textile design thereof is preferably a satin weave on which a lot of the warp comes to the surface, whereby chromophore of ultraviolet- or infrared-fluorescent yarns may be easily identified by irradiation of both ultraviolet and infrared rays on the surface of the label.

In a process for manufacturing the tape, there are utilized at least two kinds of ultraviolet-fluorescent yarns with different chromophore, into which dope kneaded with fluorescent material is spun. The process comprises the step of winding ultraviolet-fluorescent yarns together with normal colorless yarns around a warp beam in warping operation, arranging ultraviolet-fluorescent yarns repeatedly in specific color order in the traverse direction, and then weaving ultraviolet-fluorescent yarns and colorless yarns as the warp with a wide loom. The ultraviolet-fluorescent yarns are interwoven in specific color order over the total width of a textile. The double-wide textile is cut into tapes with heating in the broader width than a space where the color order of the ultraviolet-fluorescent yarns may be identified.

In the process for manufacturing the tape, a prescribed width of the first and end rows of ultraviolet-fluorescent yarns are preferably defined while arranging them repeatedly in specific color order in the traverse direction. After woven, the double-wide textile is cut into tapes with heating in the broader width than a space where the first and end rows of ultraviolet-fluorescent yarns exist in the tape.

In the process of manufacturing the tape, it is preferable that infrared-fluorescent yarns are wound together with ultraviolet-fluorescent and normal colorless yarns around a warp beam in warping operation and these yarns are woven as the warp with a wide loom. In the wide loom, rows of the warps are opened with dobby or tappet machine. Preferably, a double-wide satin textile on which a lot of the warp comes to the surface is woven with the wide loom while inserting colorless yarns of synthetic fiber as the woof into a shuttle path caused by this opening movement. It is also preferable that the warp and the woof of colorless yarns are made out of non-bleached polyester fiber.

Means for Solving the Problem

Illustrating the present invention with the drawings, plural photochromic yarns 6 which cannot be identified under a visible light are shown in FIG. 3. A security tape 1 according to the present invention is substantially colorless under a visible light, on which washing-indication mark M (FIG. 1), descriptive label, use-attention mark, trademark or the like will be printed. The tape may be directly used as a ribbon or an ornament tape or cut into labels after designs and/or characters were printed on the surface thereof. For example, a printed label 2 with washing indication mark M in FIG. 1 is sewn on the reverse side of goods C like garment. The mark M including characters and/or designs is continuously printed on the woven colorless tape 1 (FIG. 3) with letterpress- or screen-printing machine and the tape thus printed is cut into pieces in the traverse direction to obtain a label 2. This printing operation may be carried out not only by label manufacturer, but also by label user to which the tape 1 is delivered.

As shown in FIG. 11, a double-wide textile 7 is woven out of photochromic yarns 6 together with general colorless yarns as the warp and then a tape body 3 (FIG. 3) is manufactured by cutting the textile 7 into tapes with heating. If desired, it is also possible to weave the tape body 3 one by one with a narrow loom such as a needle loom. In this case, it is unnecessary to cut into tapes with heating. The tape body 3 may be woven with dobby or tappet machine in combination with a high-speed loom and there is no need to utilize especially Jacquard because the tape is comparatively simple and thin textile design.

The tape body 3 is not only substantially colorless when irradiating it with neither ultraviolet rays nor infrared rays, but also may be white or light color to such an extent that the identification of chromophore is not inhibited. The tape body 3 is also a non-bleached or off-white cloth with or without a ground pattern. In a case of carrying out bleaching treatment, the tape body requires bleaching without a fluorescent agent.

In FIG. 3, photochromic yarns 6 are the warp and/or woof woven into the tape body 3. When photochromic yarns 6 are the warp as shown in FIGS. 2 and 3, it is preferable that the textile design of the tape body 3 is five- or eight-harness satin textile on which plenty of the warp comes to the surface. If plenty of the warp comes to the surface, printing ink spreads well, and chromophore of photochromic yarn 6 is so highly visible that identification working is easy by irradiation of ultraviolet and/or infrared rays.

As exemplified in FIGS. 1 to 3, at least two kinds of ultraviolet-fluorescent yarns 5 with different chromophore, as photochromic warp yarn 6, are woven into the tape body 3 in parallel with other yarns. In the tape width W, ultraviolet-fluorescent yarns 5 repeat in specific color order in the side direction. For example, ultraviolet-fluorescent yarns 5 are composed of filaments spun out of synthetic resin in which an inorganic fluorescent material having a particle size of 4-7 microns is kneaded. Ultraviolet-fluorescent yarns 5 are so determined that it gets the same denier as normal colorless yarns by twisting plenty of filaments. The resin containing the inorganic fluorescent material may be polyester, polyamide, acrylic, poly-acetate, polyolefin or cellulose acetate as same as normal colorless yarns, preferably polyester fiber in respect of durability and cost usually. Colorless yarns used as the warp and woof are not bleached or they are non-fluorescence bleached yarns so that identifying operation can be carried out by radiation of ultraviolet rays.

As the fluorescent material kneaded into ultraviolet-fluorescent yarns 5, blue fluorescent material has chemical composition of $Sr_4Al_{14}O_{25}$:Eu,Dy (peak wavelength: 490 nm.), $Sr_5(PO_4)_3Cl$:Eu (peak wavelength: 445 nm.), ZnS:Ag (peak wavelength: 450 nm.), $CaWO_4$ (peak wavelength: 425 nm.) or the like. Green fluorescent material has chemical composition of $SrAl_2O_4$:Eu,Dy (peak wavelength: 520 nm.), $Zn_2GeO_4$:Mn (peak wavelength: 534 nm.), ZnS:Cu,Al (peak wavelength: 530 nm.), $Zn_2SiO_4$:Mn (peak wavelength: 525 nm.) or the like. Red fluorescent material has chemical composition of $Y_2O_2S$:Eu (peak wavelength: 626 nm.), $Y_2O_3$:Eu (peak wavelength: 611 nm.), YVO:Eu (peak wavelength: 619 nm.) or the like. Violet fluorescent material has chemical composition of $CaAl_2O_4$:Eu,Nd (peak wavelength: 440 nm.). By mixing two or more of said fluorescent materials, it is possible to obtain purple, orange or pink fluorescent material. For example, when this fluorescent material is irradiated with a small lamp 8 (FIG. 2) having black light emitting ultraviolet rays of excitation wavelength 300-400 nm, it emits a beam of a predetermined color light and generate little afterglow. This fluorescent material does not emit a light with irradiation of a general visible light.

When two or more kinds of ultraviolet-fluorescent yarns 5 with different chromophore are interwoven into the tape body 3, they are repeated in specific color order in the traverse direction. Label users can be therefore identified by the repetition pattern. As for the repetition pattern, there are two cases of which the one is a simple repetition and the other is an arrangement that provides the first and end rows. Since the printed label 2 is arranged optionally when sewing it on a wear C, it is indispensable to be able to identify the repetitive pattern regardless the arrangement direction thereof. In FIGS. 4 to 8, different kinds of ultraviolet-fluorescent yarns 5 are illustrated respectively, namely, a red chromophore is shown in 5R, a green chromophore is shown in 5G, a blue chromophore is shown in 5B, a violet chromophore is shown in 5M, an orange chromophore is shown in 5D and a pink chromophore is shown in 5P.

Examples of a simple repetitive pattern are disclosed in FIGS. 5 and 6. The number of patterns is basically calculated by repeated permutation except that a pattern turns to the same as the other when the first row shifts. Two kinds of ultraviolet-fluorescent yarns 5R and 5G are repeated every four rows in FIG. 5 and every five rows in FIG. 6. For instance, as for two kinds of ultraviolet-fluorescent yarns, there are three patterns (5G), (5R) and (5G, 5R) in two rows, added two patterns (5G, 5G, 5R) and (5G, 5R, 5R) in three rows, further added three patterns (5G, 5G, 5G, 5R), (5G, 5G, 5R, 5R) (see FIG. 5) and (5G, 5R, 5R, 5R) in four rows, and further added four patterns (5G, 5G, 5G, 5G, 5R), (5G, 5G, 5G, 5R, 5R), (5G, 5G, 5R, 5R, 5R) and (5G, 5R, 5R, 5R, 5R) (see FIG. 6) in five rows. In every five rows, accordingly, the number of repetitive patterns is twelve as a whole. The row space between each of yarns 5 may be roughly divided into three intervals such as 1 mm, 1.5 mm and 2 mm pitch. In case of every five rows, 36 classifications may be obtained by multiply twelve repetition patterns and three row spaces together.

When some tape maker dedicates an individual pattern in 36 patterns to each one of customers such as tape users and label suppliers, he can control individually security labels that the total number of 36 companies put to use.

In case of simple repetitive pattern of two kinds of ultraviolet-fluorescent yarns 5, there are obtained eight patterns in every four rows and four patterns in every three rows. Accordingly less than three rows of repetition are so unpractical that the number of patterns is too few. Every four rows are probably practical in only small-scale label maker because 24 label users may be specified by multiply eight patterns and three row spaces together.

As for three kinds of ultraviolet-fluorescent yarns 5, 15 patterns are obtained in every four rows. Therefore, more than three rows for three kinds and more than two rows for four or five kinds are almost practical. On the tape 1 or the printed label 2, a minimum cut interval, i.e., minimum width W (see FIG. 3) may be decided on twice of specific pattern interval so that the pattern interval can be identified regardless the arrangement direction thereof. So as to increase the number of distinguishable patterns, it is possible to weave two ultraviolet-fluorescent yarns 5 in the first row of the pattern only, change the row space between each of ultraviolet-fluorescent yarns 5, or interweave infrared fluorescent yarns with yarns 5.

In case of repetition with first row and end row, it is necessary to provide first row 9 and end row 10 of the pattern interval P so that it can be identified regardless the arrangement direction of the label as shown in FIG. 7. With respect to the pattern interval P of ultraviolet-fluorescent yarns 5, for instance, a space 12 between the end row 10' of the adjacent pattern and the first row 9 of the pattern interval P is twice as wide as a normal interval and a space 16 between the previous-end row 14 and the end row 10 of the pattern interval P is one-and-a-half times as wide as the normal interval. The spaces 12 and 16 may be provided optionally on a space different from the normal interval. Instead of changing the row space, two ultraviolet-fluorescent yarns 17 (FIG. 8) may be interwoven into the first row 9 or three ultraviolet-fluorescent yarns may be interwoven into the end row 10. The interweave number of these yarns may be provided optionally. The first and/or end rows 9 and 10 may be specified with infrared-fluorescent yarns 18 (FIG. 8) or ultraviolet-fluorescent yarns with other chromophore. It is possible to combine these means of specification suitably.

The number of the pattern interval P may be calculated by repeated permutation ${}_n\Pi_r$ when the first and end rows 9 and 10 are specified and repeated. The number of the patterns is $2^3=8$ in every three rows of two kinds of ultraviolet-fluorescent yarns 5, which is too few. The number of the patterns is $3^3=27$ in every three rows of three kinds of ultraviolet-fluorescent yarns 5, which is practical in small-scale label maker. If the row space is changed to provide the first and end rows 9 and 10, it is not preferable to add modification of the row space for increasing the number of patterns because of positional confusion. In practice, it is preferable to be $4^4$=256 or more patterns in which four kinds of ultraviolet-fluorescent yarns 5 are repeated in every four rows, or to be 6×5×4×3×2=720 patterns calculated by permutation $_nP_r$ in which six kinds of ultraviolet-fluorescent yarns 5 are repeated in every six rows by non-repetition (see FIG. 7).

Infrared-fluorescent yarns 18 (FIG. 8) may be added to the photochromic yarns 6 or applied instead of one kind of the ultraviolet-fluorescent yarns. Inorganic fluorescent material kneaded into the yarns 18 is excited temporarily and then emits a visible light such as green, red, yellow, blue or purple chromophore distinguishable easily by irradiating it with infrared rays of excitation wavelength 780 nm-1 mm. The material does not emit a light by irradiation of a visible right or without luminous source, which generates little afterglow and capable of keeping luminescence for a long time. This material might generate bright luminescence by adding specific impurity in condition of crystal. It is preferable to add inorganic activator or sensitizer as the impurity. The surface of this material may be treated with oxides or salts such as chrome or manganese to improve stability thereof when adding to resin dope.

As fluorescent material mixed into infrared-fluorescent yarns 18, europium compound, samarium compound, zinc sulfide compound, zinc oxide compound or silicate zinc compound may be exemplified or $LiAlO_2$:Fe, (Zn.Cd)S:Cu, $YVO_4$:Nd or the like may be added to the material. Liquid organic compound emitting a visible light by irradiation of infrared rays may be also attached to the fluorescent material. It is possible to mix resin powder containing said organic compound or add inorganic powder absorbing infrared rays of a specific wavelength to the fluorescent material. This fluorescent material is the average particle size of 2-3 micron meters and 95% thereof is the particle size less than 7 micron meters. It is preferable to add about 3-10% in weight of this material to dope. When less than 3% in weight of the material is add, it is difficult to detect infrared-fluorescent yarns for the reason that luminescence weakens. More than 10% in weight thereof is uneconomical and affects spinning operation negatively.

So as to produce a security tape of the present invention, plural bobbins 22 for at least two kinds of ultraviolet-fluorescent yarns 5 and normal colorless yarns are mounted on a creel 23 in accordance with the textile design in non-drum or drum type warper 20 as shown in FIG. 9. These many yarns 25 are drawn out from each bobbin 22, arranged in parallel and wound about a slasher beam 24 or a drum while giving certain tension. The beam 24 is nearly the same width as a warp beam 26 (FIG. 10). These yarns are drawn out from the beam 24, sized and then wound about the warp beam 26. It is also possible to arrange a sizing machine (not shown) between the warper 20 and creel 23 in FIG. 9 so that yarns are sized while warping and then wound around the warp beam 26 directly.

FIG. 11 illustrates schematically the whole side view of a loom 28. For example, the warp beam 26 is rotatably disposed behind the high-speed wide loom 28 such as a rapier loom. In the loom 28, the warp 30 of ultraviolet-fluorescent yarns 5 and normal colorless yarns is carried from the warp beam 26 through plural back rollers 32, healds 34 and a rapier 36 to the woven lead 38. After the warp 30 was divided up and down with lease rods 40 arranged in the transverse direction, it is passed through a hole of the healds 34 individually. Each of the healds 34 moves vertically so that a group of the warp is opened in the longitudinal direction and then the weft is inserted with the rapier 36 or a shuttle. The weft is surged to the woven lead 38 with a slay (not shown) to weave a double-wide textile 7 by intersecting the warp 30.

The double-wide textile 7 thus woven is carried from the woven lead 38 via a guide roller 42 to a take-up roller 44 and then passes through the roller 44 and a pair of press rollers 46, 46. In the loom 28, plurality of heated knives 48 is diagonally attached before or behind the press rollers 46, 46, with which the double-wide textile is cut into tapes in width W with heating. It is easy to adjust the lateral position of each heated knife 48. The tapes 1 thus obtained are passed through an ironing roller 50 to stabilize the form thereof and then wound up to a cloth beam 52. The double-wide textile 7 may be also cut into tapes 1 with other heat-cutting machine after it was wound up the cross reel 52.

As exemplified in FIGS. 4 to 8, at least two kinds of ultraviolet-fluorescent yarns 5 are interwoven repeatedly in specific color order over the total width while weaving the double-wide textile 7 and then the textile is cut into tapes 1 with heating. In this heat cutting, the minimum width W of the tape is provided only twice or more the pattern interval P, and neither additional operation nor other apparatuses is needed at the time when ultraviolet-fluorescent yarn 5 and infrared-fluorescent yarn 18 are interwoven (see FIG. 4). Even if the tape 1 or printed label 2 is any width, many useful tapes can be simultaneously made of the double-wide textile 7 only by modifying the width of heat cutting.

For example, all of the obtained tapes include certainly at least one specific pattern interval P, respectively, when the double-wide textile is cut up into tapes in width as same as or broader than the minimum width W. The widths of these tapes may include W, W1, W2, W3 and/or the like at the same time, as shown in FIG. 4. It is advantageous to cost and working reductions that waste pieces do not come out of the double-wide textile when cutting.

A label manufacturer will provide basically one kind of double-wide textile 7 for each company or customer even if the size of printed label 2 for which the customer gives an order is various. In the warping process shown in FIG. 9, ultraviolet-fluorescent yarns 5 and normal colorless yarns are wound around a slasher beam 24 or drum while giving certain tension. The slasher beam 24 or warp beam 26 will be managed and preserved for each customer.

For example, some middle customer will use five kinds of security labels in different widths such as 10 mm, 20 mm, 30 mm, 40 mm and 50 mm in width. He will give the manufacturer an order for total 2000000 sheets of the labels, namely 400000 sheets per each label width. It is assumed that the average size of the labels is 30 mm in width and 100 mm in length and a roll of a double-wide textile is 1200 mm in available width and about 5000 m in length. On the average a unit length 100 mm of the double-wide textile can be made into about 40 sheets of the labels (namely 1200/30) and therefore 8 sheets per each label width (namely 40/5). It is necessary to use the double-wide textile with 5000 m in length so as to produce 400000 sheets on five width-different labels, respectively (namely (400000/8)×0.1). In this case, therefore, only one roll of the double-wide textile or one warp beam will be consumed in a year, which is very economical. On the contrary, a conventional process needs every roll of a double-wide textile or five warp beams about five kinds of security labels because there is danger that the specific pattern interval is not exist in each label when cutting the textile into width-different tapes.

The printed label 2 thus obtained is made of the tape 1 in which at least two kinds of ultraviolet-fluorescent yarns 5 are interwoven, and the label is nothing but a normal label under a visible light. When a customer or dealer irradiates the label with ultraviolet rays or black light 8 and/or infrared rays, he can identify the original pattern interval P by the photochromic yarns and confirm easily whether the goods is genuine or not. It is difficult for forgery manufacturer to discover to interweave the photochromic yarns into the printed label 2 because ultraviolet- and infrared-fluorescent yarns 5 and 18 are colorless and usually the same denier as the normal yarns. Even if forgery manufacturer can discover existence of the photochromic yarns, he cannot recognize the pattern interval P by plurality of the photochromic yarns. It is therefore almost impossible for forgery manufacturer to weave the pattern interval P into the printed label 2. The inorganic fluorescent material in ultraviolet- and infrared-fluorescent yarns 5 and 18 is less toxicity than an organic fluorescent material and also excellent in weather resistance and print properties.

Effect of the Invention

A security tape according to the present invention is not for woven tape or label where color yarns are interwoven, but is substantially colorless and plain under a visible light for the purpose of printing washing-indication, trade mark or the like on the label. The tape of the present invention is often composed of simple satin weave in which ultraviolet- and infrared-fluorescent yarns are easily interwoven in parallel over the total width thereof. The tape of the present invention is colorless by irradiation of a visible light, accordingly the identification of red, blue and/or green chromophore is easy by irradiating the tape with ultraviolet and/or infrared rays so that the specific repetition pattern can be recognized surely.

The printed label made of the tape according to the present invention is identical with a normal label under a visible light even if ultraviolet- and infrared-fluorescent yarns are interwoven into the tape. In case of doubting whether the goods is genuine or spurious, it is possible to confirm that the specific repetition pattern is recognized by irradiating the printed label with ultraviolet and/or infrared rays. In this printed label, the specific repetition pattern by interweaving ultraviolet-fluorescent yarns etc. cannot be distinguished by visual observation only, accordingly forgery manufacturer finds it difficult to manufacture the same label. As for the garment or the like on which the printed label are sewn, the imitation article is certainly prosecuted at the early stage by means of the printed label even if it resembles such closely that a professional dealer in garment cannot identify from the outside thereof.

In the process for producing the security tape, ultraviolet-fluorescent yarns etc. are interwoven repeatedly in specific color order while weaving a double-wide textile and plural tapes may be simultaneously made of the double-wide textile, provided that the tape width is more than the color order can be distinguished. Label manufacturer will accordingly provide basically one kind of double-wide textile and preserve a beam wound with warped yarns for each customer even if the size of printed label for which the customer gives an order is various. Label manufacturer can easily provide printed label used for security label for each customer even if customers who utilize various sizes of printed label exceed one hundred companies, and he can also manage and preserve the labels easily.

In this producing process, ultraviolet-fluorescent yarns are merely interwoven with normal colorless yarns while weaving the double-wide textile. It is not necessary to arrange another assembly or additional process when interweaving yarns, but it is possible to manufacture inexpensive printed label for security with nearly the same equipment as previous. By virtue of the present invention, label manufacturer may not only deliver printed labels with washing indication or descriptive labeling to garment-production user, but also he may deliver white plain tapes to customer who will print desired washing indication or descriptive labeling. It is therefore feasible for label manufacturer to achieve increment of sales amount and expansion of market about white tapes in addition to selling printed labels.

EXPLANATIONS OF NUMERALS

Figure 1:
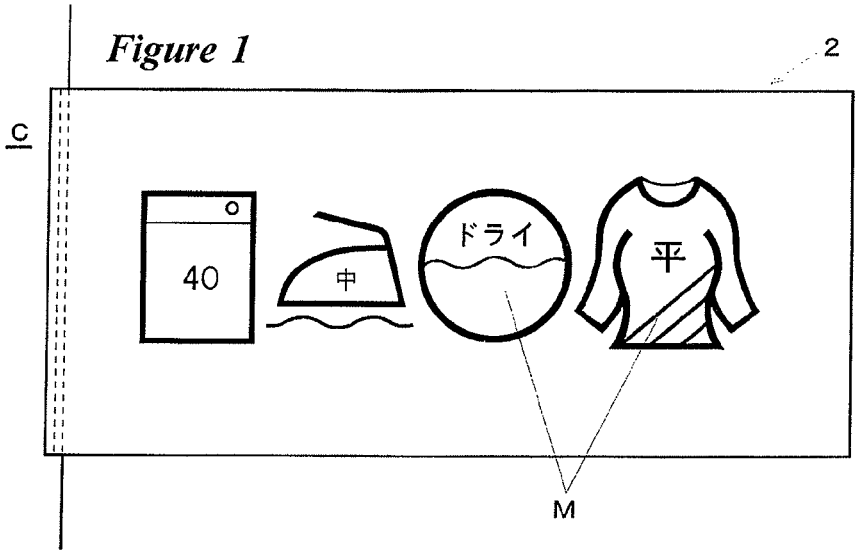
FIG. 1 is a plan view showing a printed label under a visible light such as a sunlight or fluorescent light.
Figure 2:
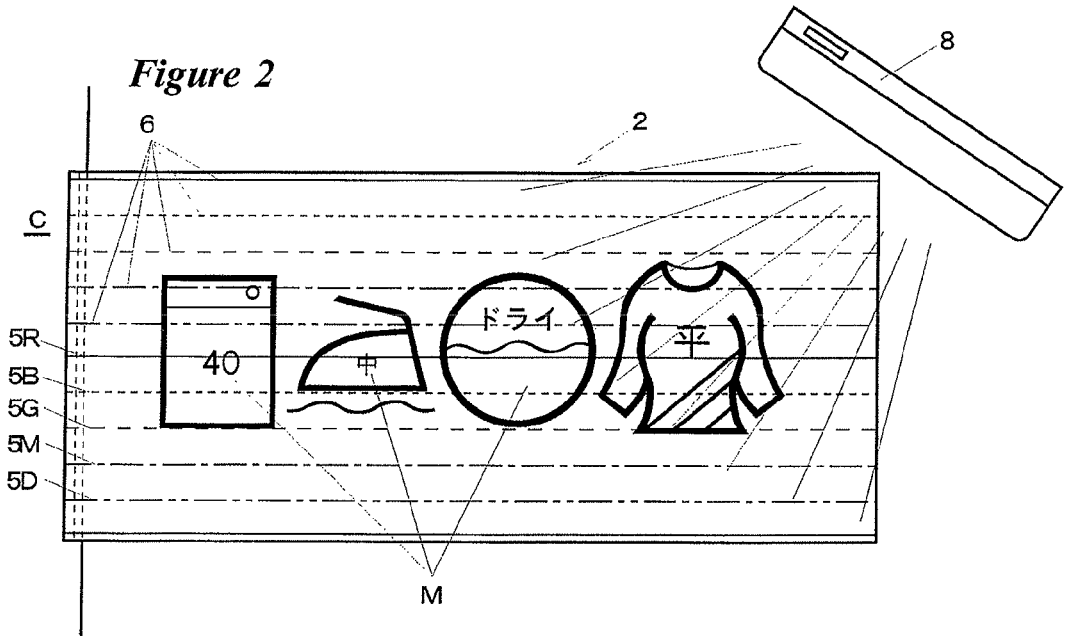
FIG. 2 is a plan view showing a situation where the printed label of FIG. 1 is irradiated with a black light.
Figure 3:
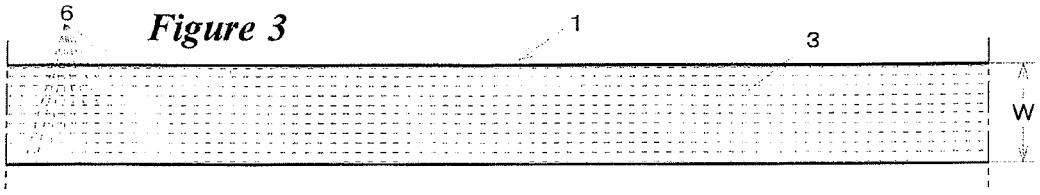
FIG. 3 is a partial plan view showing a colorless security tape according to the present invention under a visible light, a dotted line being drawn for photochromic yarn in this plan view.
Figure 4:
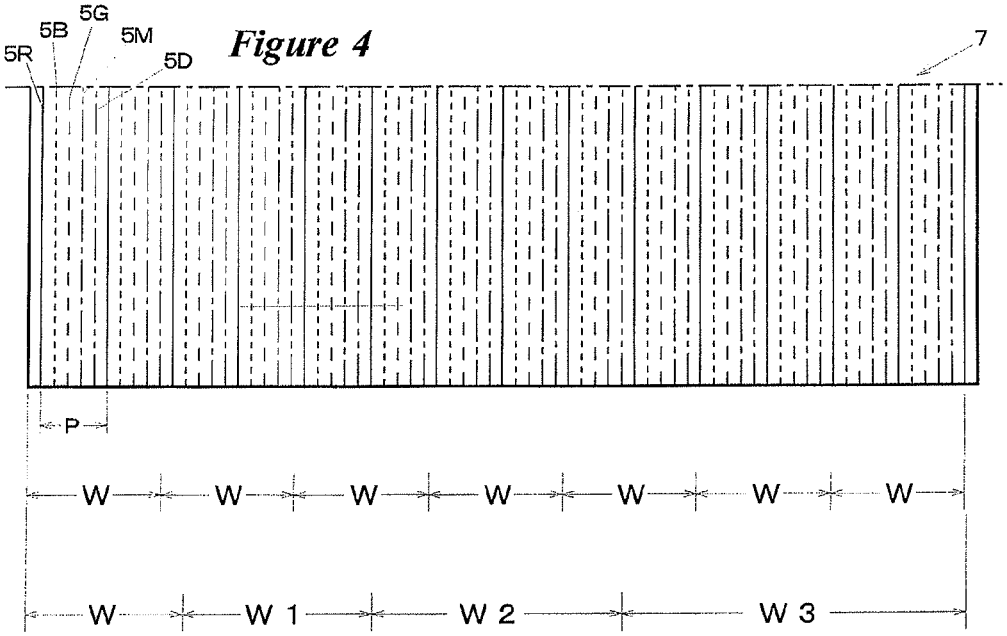
FIG. 4 is a partial plan view exemplifying a double-wide textile before cutting into tapes with heating in a situation where it is irradiated with ultraviolet rays.
Figure 5:
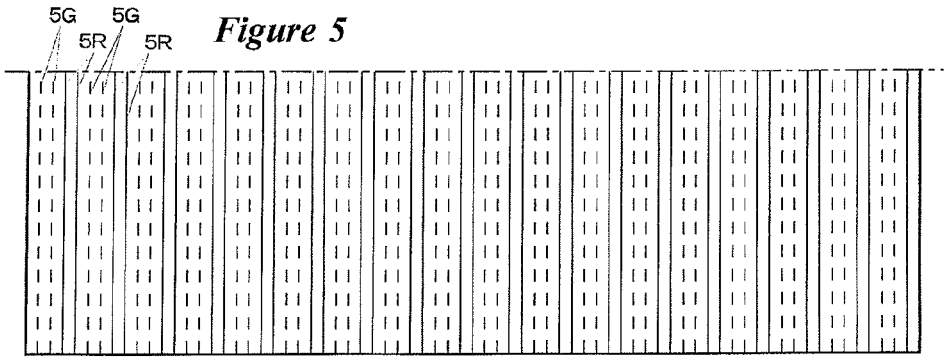
FIG. 5 is a partial plan view showing second embodiment of a double-wide textile in a situation where it is irradiated with ultraviolet rays.
Figure 6:
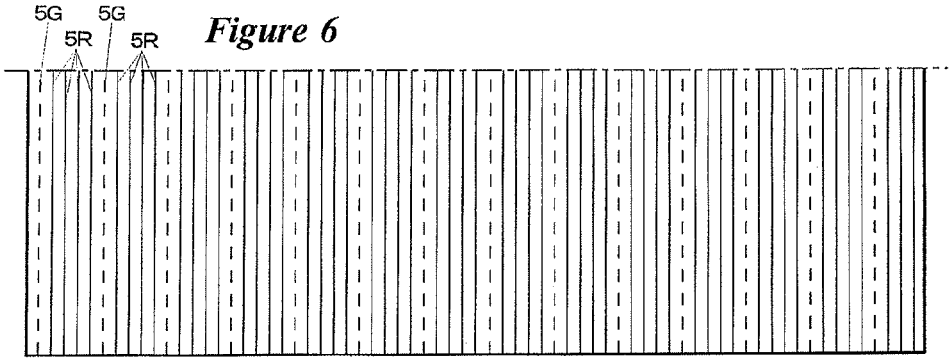
FIG. 6 is a partial plan view showing third embodiment of a double-wide textile in a situation where it is irradiated with ultraviolet rays.

1 security tape
2 printed label
3 tape body
5 ultraviolet-fluorescent yarn
6 photochromic yarn
18 infrared-fluorescent yarn

EXAMPLE 1

The present invention is now illustrated on the basis of examples, but the present invention will not be limited to the examples.

Each ultraviolet-fluorescent yarn 5 was twisted from twelve polyester filaments, into which polyester containing an inorganic fluorescent material with the particle size of 4-7 micron meters was spun. The yarn 5 has a fineness of 7.5 deniers. In the meantime, a non-bleached colorless yarn was twisted out of 24 polyester filaments, which is similar in a fineness of 7.5 deniers.

As the inorganic fluorescent material, there were used six kinds of chromophore with different fluorescent colors such as blue chromophore (chemical composition: $Sr_4Al_{14}O_{25}$:Eu, Dy), green chromophore (chemical composition: $SrAl_2O_4$: Eu,Dy), red chromophore (chemical composition: $Y_2O_2S$: Eu, $Y_2O_3$:Eu), violet chromophore (chemical composition: $CaAl_2O_4$:Eu,Nd), orange chromophore and pink chromophore. These fluorescent materials emit a certain color light when irradiating them with a black light 8. They generate little afterglow and have properties that do not emit a light by irradiation of normal sunlight or fluorescent lamp light.

Figure 7:
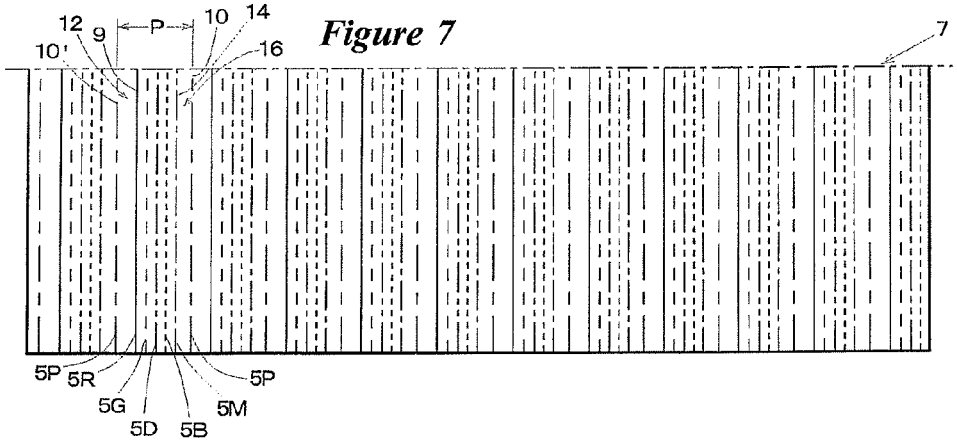
FIG. 7 is a partial plan view showing fourth embodiment of a double-wide textile in a situation where it is irradiated with ultraviolet rays.
Figure 9:
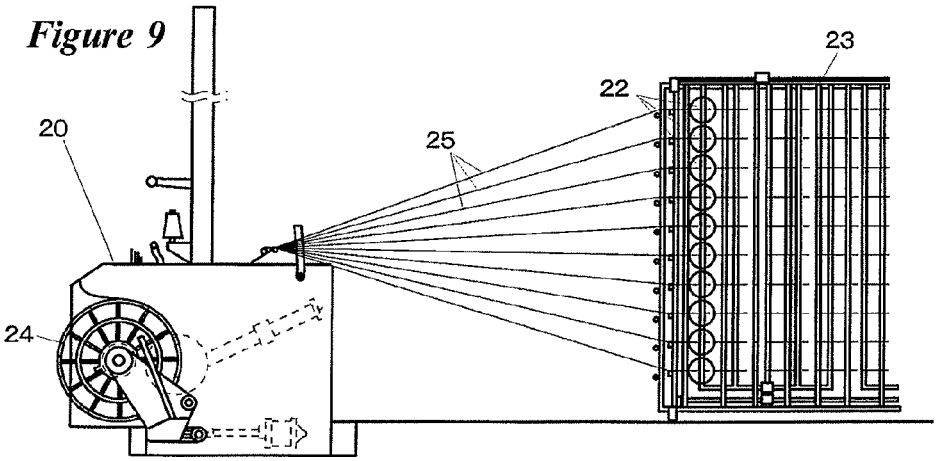
FIG. 9 is a schematic side view showing a beam warper in which ultraviolet-fluorescent yarns and colorless yarns are wound from plural bobbins around slasher beams.
Figure 10:
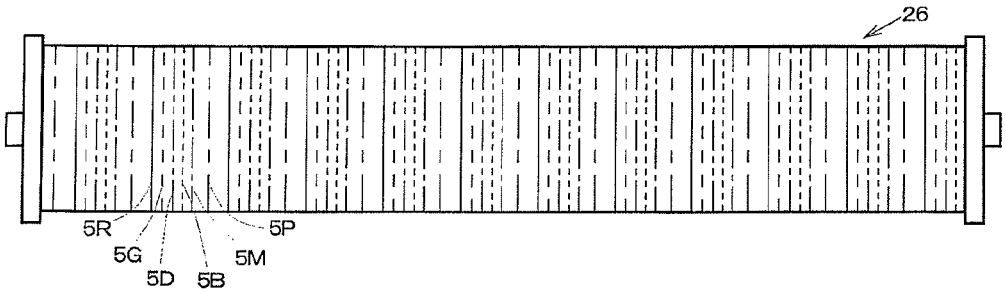
FIG. 10 is a side view showing one embodiment of a warp beam on which ultraviolet-fluorescent yarns and colorless yarns are wound.

In the warping process, bobbins 22 wound with six kinds of ultraviolet-fluorescent yarns 5 and white polyester yarns were arranged on a creel 23 of non-drum type warper 20 according to number, order, width and density based on the textile design, as shown in FIG. 9 and the yarns were wound around slasher beams 24 while giving certain tension. Although not shown, the yarns were then rewound from the slasher beam 24 to a warp beam 26 (FIG. 10) with a sizing machine. The warp beam 26 is a type of 5000 meters in yarn length. As shown in FIG. 7, red-photochromic fluorescent yarn 5R, green-photochromic yarn 5G, orange-photochromic yarn 5D, blue-photochromic yarn 5B, violet-photochromic yarn 5M and pink-photochromic yarn 5P are arranged at 1.0 millimeter pitch in six non-overlapping rows. In this case, these yarns were so arranged that a space 12 between the end row 10' of a neighbor pattern or the yarn 5P and the first row 9 of the pattern interval P or the yarn 5R is 2.0 millimeters in width, and a space 16 between the previous end row 14 of the pattern interval P or the yarn 5M and the end row 10 or the yarn 5P is 1.5 millimeters in width. The width of the specific pattern interval P is 2.0+1.0×4+1.5=7.5 millimeters.

Figure 11:
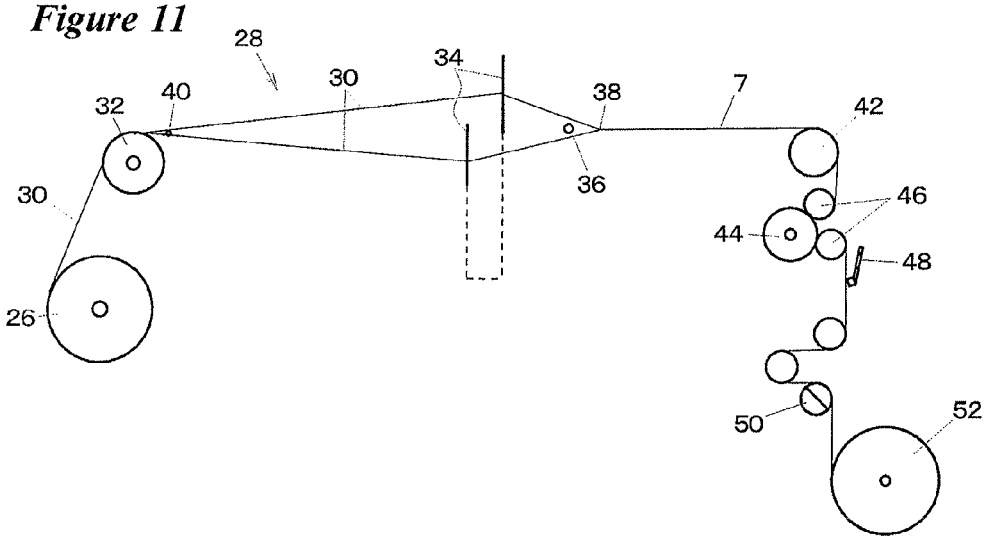
FIG. 11 is an explanatory drawing showing a loom in which yarns wound off a warp beam are woven into a double-wide textile and the textile is cut into tapes with heating immediately after weaving.

In the weaving process, the warp a beam 26 (FIG. 10) was rotatably disposed behind a rapier loom 28 shown in FIG. 11. The warps 30 wound off the warp beams 26 were woven into five-harness double-wide satin textile 7 on which plenty of the warp comes to the surface by causing the opening movement for the warps with a tappet machine (not shown) and inserting a colorless polyester yarn as the woof into a shuttle path produced by this opening movement with a rapier 36. The double-wide textile 7 has the specific pattern interval P of 7.5 millimeters in width. Plural hot knives 48 were attached to the rapier loom 28 behind press rollers 46, 46. The double-wide textile 7 woven with about 120 to 200 centimeters in width was cut into tapes immediately within the rapier loom.

By cutting the double-wide textile 7 into tapes with heating, it was possible to obtain simultaneously a lot of tapes 1 from the double-wide textile and then wind them about crossing reels 52, respectively. The heat-cut width of the tape 1 was twice the pattern interval P, namely, the minimum cut space was 15.0 millimeters so that the pattern interval P can be identified regardless the arrangement direction thereof. In the case of this example, it was feasible to produce simultaneously 13 of tapes from the textile.

On the wound tape 1, given designs M and/or characters were continuously printed with black ink containing general pigments by means of a letterpress-printing or screen-printing machine. The printed tape body 3 was cut into pieces every 40 millimeters in length with the cutting section of a cutting-and-holding machine. Sequentially, the cut pieces of the tape were sent to the holder section of the machine so that the piece was held at the center thereof and pressed to obtain printed labels 2 (FIG. 1) with every washing-indication M. The printed label 2 was finally sewn on the reverse side of a garment C or the like.

The printed and sewn label 2 keeps colorless because ultraviolet-fluorescent yarn 5 does not emit a light under a visible light. While a customer himself and/or a dealer irradiates the label with ultraviolet rays by means of black light 8, he can identify the specific pattern interval P exclusive to each customer by the photochromic yarns 5. Therefore, he can confirm easily whether the wear C is genuine or not. As for the printed label 2, it was difficult to know the weave of the fluorescent yarns 5 because they were colorless and usually the same fineness as the surrounding general yarns. It was also impossible to identify the specific pattern interval P by means of plural photochromic yarns even if the existence of the photochromic yarns could be confirmed.

The specific pattern interval P existed certainly in the tape when the cut width thereof was more than 15.0 centimeters. It is therefore possible to prepare the printed labels 2 with a different width from the double-wide textile 7 only if the cut width thereof is modified. For preparing the printed label 2, the label manufacturer has only to manage and store the beam 24 on which wound these yarns for each customer separately. Because six kinds of the ultraviolet-fluorescent yarns 5 were arranged in six rows without overlap so that 720 patterns were obtained by permutation, the label manufacturer is able to provide each customer with an exclusive security label even if the number of customers i.e., sewn products manufacturers exceed about 100 companies.

EXAMPLE 2

Five kinds of ultraviolet-fluorescent yarns 5 were manufactured in the same manner as Example 1. Five kinds of ultraviolet-fluorescent yarns 5 were interwoven into a tape 1 by arranging in four rows with overlapping repetition. Embodiments of the tape 1 were, for instance, shown in FIGS. 8A and 8B. Five interwoven fluorescent yarns 5 were red-photochromic yarns 5R, blue-photochromic yarns 5B, green-photochromic yarns 5G, violet-photochromic yarns 5M and orange-photochromic yarns 5D. However, orange-photochromic yarn 5D was not utilized in FIG. 8A and blue-photochromic yarn 5B was not utilized in FIG. 8B.

As for infrared-fluorescent yarn 18, an inorganic fluorescent material with the average particle size of 2-3 micron meters, which contains europium and zinc sulfide compounds, was kneaded into polyester and then the polyester was spun into filaments. 12 filaments were twisted into the yarn 18 having a fineness of 7.5 deniers. The infrared-fluorescent yarn 18 emitted a green visible light when irradiating it with infrared rays having excited wavelength of 780 nanometers-1 millimeter and did not emit a light by irradiation of general sunlight or non light source.

Figure 8A:
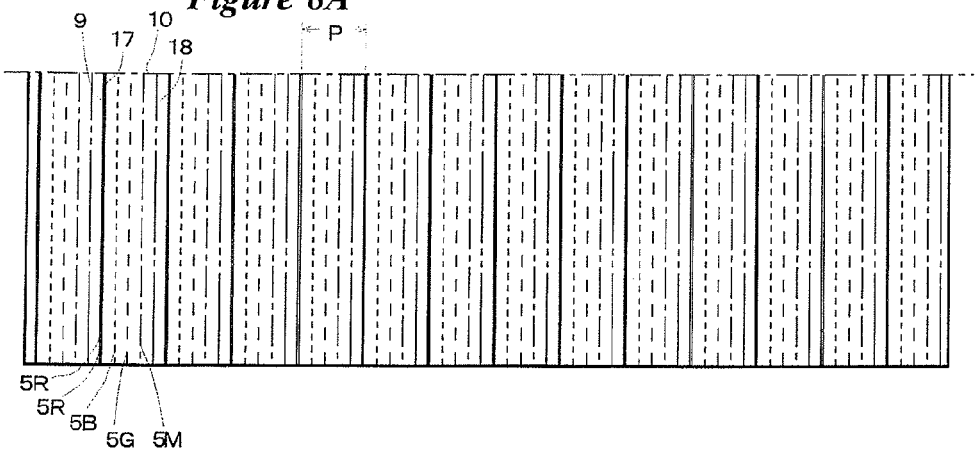
FIGS. 8A and 8B are partial plan views showing fifth example of a double-wide textile in a situation where they are irradiated with ultraviolet and infrared rays, respectively.
Figure 8B:
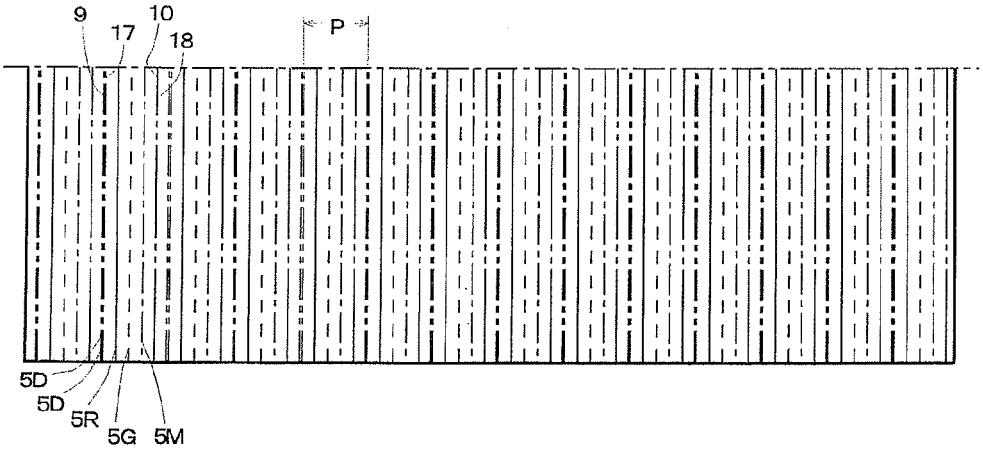

In the warping process, four kinds of ultraviolet-fluorescent yarns 5, infrared-fluorescent yarn 18 and white polyester yarns pulled out of bobbins 22 were wound around slasher beams 24 while giving certain tension. As exemplified in FIG. 8A, red-photochromic yarns 5R, 5R were arranged in the first row 9 as two ultraviolet-fluorescent yarns 17 and infrared-fluorescent yarn 18 was arranged in the end row 10. Blue-photochromic yarn 5B, green-photochromic yarn 5G and violet-photochromic yarn M were arranged in overlapping four rows at 1.0-millimeter pitch. In FIG. 8, the space of the specific pattern interval P is 1.0×5=5.0 millimeters in addition to infrared-fluorescent yarn 18. These yarns were wound from the slasher beam 24 about a warp beam in a sizing machine.

In the weaving process, the warp 30 pulled out of the warp beams 26 was woven into five-harness satin width textile 7 on which plenty of the warp comes to the surface by inserting colorless polyester yarn as the woof into a shuttle path within a wide loom 28 (FIG. 11) with a dobby machine (not shown). The double-wide textile 7 has the specific pattern interval P of 7.5 millimeters in width by this weaving. Plural hot knives 48 were attached behind press rollers 46 to the wide loom 28. The double-wide textile 7 with about 200 centimeters in width was woven and cut into tapes immediately.

By cutting the double-wide textile 7 into tapes with heating, it was possible to obtain simultaneously a lot of colorless tapes from the double-wide textile. According to the tape 1, the heat-cutting width thereof was twice the pattern interval P, namely, the minimum cutting space was 10.0 millimeters. On the wound tape 1, given designs M and/or characters were continuously printed with black ink containing general pigments by means of a letterpress-printing or screen-printing machine. The printed tape was cut into pieces every 30 millimeters in length with a cutting section of a cutting-and-holding machine. Sequentially, the cut pieces of the tape were sent to a holder section of the machine so that the piece was held at the center thereof and pressed.

The printed and sewn label 2 keeps colorless because ultraviolet-fluorescent and infrared-fluorescent yarns 5 and 18 does not emit a light under a visible light. While a customer himself and/or a dealer irradiates the label with ultraviolet rays by means of black light 8, he can identify the specific pattern interval P exclusive to each customer by the photochromic yarns 5. While he also irradiates the label with infrared rays, the tape 2 emits a green visible light. Therefore, he can confirm easily whether the labeled wear is genuine or not. As for the printed label 2, it was difficult to know the weave of the ultraviolet-fluorescent yarns 5 and then identify the specific pattern interval P. It was further difficult to know the interweave of the infrared-fluorescent yarns 18.

The specific pattern interval P existed certainly in the colorless tape when the cut width thereof was more than 10.0 centimeters. It is therefore possible to prepare the printed labels 2 with a different width from the double-wide textile 7 only if the cut width thereof is modified. Because five kinds of the ultraviolet-fluorescent yarns 5 were arranged in overlapping four rows so that 625 patterns were obtained by permutation, the label manufacturer is able to provide each customer with an exclusive security label even if the number of customers i.e., sewn products manufacturers exceed about 100 companies.

What is claimed is:

1. A process for manufacturing a tape with specific pattern interval, the tape having at least two kinds of fluorescent yarns different from each other in chromophore, the fluorescent yarns being spun out of dope kneaded with a fluorescent material, the process comprising:

arranging the fluorescent yarns in specific color order in transverse direction while winding the fluorescent yarns together with colorless yarns around a slasher beam;

rewinding the fluorescent and colorless yarns wound around the slasher beam to a warp beam during warping operation;

weaving the fluorescent and colorless yarns as the warp with a loom while the fluorescent yarns are interwoven in specific color order in the transverse direction, the specific color order being repeated in repetitive pattern over the total width of a double-wide textile; and cutting the double-wide textile into tapes having widths by heat-cutting, the width of each tape thus obtained being at least twice the fundamental width of the repetitive pattern.

2. The process according to claim 1, wherein a prescribed width of a first row and an end row of the fluorescent yarns are defined while arranging the fluorescent yarns repeatedly in specific color order in the transverse direction.

3. The process according to claim 1, wherein infrared-fluorescent yarns are wound together with ultraviolet-fluorescent yarns and the colorless yarns around the warp beam by beam-warping, and all the fluorescent yarns and the colorless yarns are woven as the warp with a wide loom.

4. The process according to claim 1, wherein a double-wide satin textile on which a portion of the warp comes to a surface of the satin textile is woven while opening rows of the warp, and inserting colorless yarns of synthetic fiber as the woof into a shuttle path caused by the opening of the rows within a wide loom.

5. The process according to claim 1, wherein the warp and the woof composed of colorless yarns is made of a non-bleached polyester fiber.

* * * * *